US005908052A

United States Patent [19]

Garcia

[11] Patent Number: 5,908,052

[45] Date of Patent: Jun. 1, 1999

[54] KNUCKLING APPARATUS FOR A CHAIN LINK FENCE WEAVING MACHINE

[75] Inventor: Jose G Garcia, La Puente, Calif.

[73] Assignee: BMCI, Inc., South El Monte, Calif.

[21] Appl. No.: 08/978,610

[22] Filed: Nov. 26, 1997

[51] Int. Cl.[6] ..... B21F 27/14

[52] U.S. Cl. ..... 140/92.7; 140/24

[58] Field of Search ..... 140/9, 24, 92.7, 140/105, 107

[56] References Cited

U.S. PATENT DOCUMENTS 889,815 6/1908 Schmid ..... 140/24

3,810,496 5/1974 Rohrbacher ..... 140/24

*Primary Examiner*—Lowell A. Larson

*Attorney, Agent, or Firm*—James G. O'Neill

[57] ABSTRACT

Chain link material having a coating thereon for use in fences and other various applications are formed with knuckled ends so as to improve the appearance thereof. The knuckled ends of the coated chain link fence are formed by knuckler assemblies held on either side of the coated chain link material as it moves through a weaving machine. The knuckling assemblies are moveable into and out of contact with the cut ends of coated wires woven into the chain link material, and include rotatable bend elements which contact an extended length of and bend the cut ends without cutting, marring or scraping the coating.

20 Claims, 2 Drawing Sheets

KNUCKLING APPARATUS FOR A CHAIN LINK FENCE WEAVING MACHINE

BACKGROUND OF THE INVENTION

1. Field of the Invention

This invention relates generally to chain link fabrication, and more particularly, to an improved knuckler for a chain link fence weaving machine.

2. Description of Related Art

Chain link fence weaving machines are well known in the art. Companies such as BMCI, Inc., dba as Bergandi Machinery Company of South El Monte, Calif. manufacture and sell chain link weaving machines, such as their HR 80 automatic weaving machine. In machines, such as this Bergandi Machine, two strands of wire from two large coils of wire are continuously fed onto a forming mechanism (weaving blade), so that two needles at a time are formed into a picket in an intercoiled manner and then woven in a trough weaving mechanism to form continuous links of chain link.

After being woven together, the just woven picket is cut off at the ends, and a wire fabric of open construction is formed having sharp, cut ends, the formed wire fabric is then indexed through the machine to a point along the top thereof where selvage is performed. This selvage is accomplished by turret knucklers which form knuckles by bending over the sharpened ends thereof, or other turret mechanisms to twist the ends and form sharp barbs thereon.

The barbed or knuckled ends formed on the chain link fabric are then utilized as the top and bottom of the fabric when the fence is mounted on poles, or the open wire fabric may be used in furniture, in land fill, mines, rock control, soil retention, or other areas.

For some usage, chain link may be provided with a decorative or protective coating, such as a paint or a plastic, such as polyvinylchloride (PVC). However, it has been found that when forming the knuckled ends on such coated or painted chain link fabric, the known turret knucklers will cut the coating, or scrap off the paint on the fabric, thus defeating the original intent of adding the coating. Therefore, there exists the need in the art for a knuckler for forming knuckled ends on coated chain link fabric which does not cut, mar or scrap off the coating.

SUMMARY OF THE INVENTION

It is therefore, a general object of the present invention to provide an improved knuckler for a chain link fence weaving machine. It is a particular object of the present invention to provide an improved knuckler for bending over the cut ends of coated chain link fabric. It is another particular object of the present invention to provide an improved apparatus for bending over the cut ends of woven chain link fence having a coating thereon to perform selvage without harming the coating. It is another particular object of the present invention to provide knuckling apparatus for bending over the cut ends of coated wire fabric, which knuckling apparatus has rotatably bending elements. And, it is still a further particular object of the present invention to bend the cut ends of coated chain link material to form knuckled ends having no cuts, mars or scrapes thereon.

These and other objects of the present invention are achieved by providing apparatus for bending the cut ends of coated wire woven into a chain link material. The bending of the cut ends of the coated chain link material is performed at selvage stations at both ends of the fabric, in a chain link fence weaving machine. The cut ends of the coated chain link material are bent into a desired position at the selvage stations without cutting, marring or scraping the coating thereon.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved, simplified knuckling apparatus to bend over or knuckle the cut ends of a coated chain link fabric or material.

Figure 1:
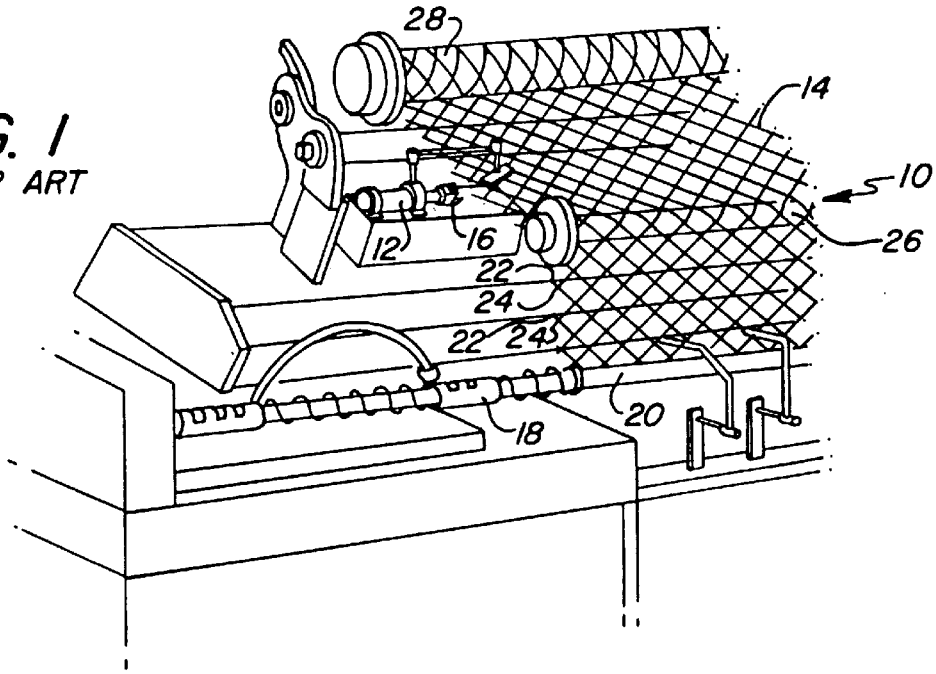
FIG. 1 PRIOR ART
FIG. 1 is a partial, perspective, schematic view showing a prior art chain link fence weaving machine having a knuckler apparatus thereon.

Referring now to FIG. 1 of the drawings, there shown is a schematic representation of a known chain link fence weaving machine 10. This weaving machine is of the so-called slant top type and has incorporated therein, known end knuckling turret assemblies or knucklers 12, only one of which is shown. It is to be understood that two such turrets are normally located on opposite sides of chain link material 14, traveling through the machine. The turrets 12 include a pair of knuckling blades 16, which contact and bend over the cut ends of the wire fabric, at opposite sides of the fabric material. The knuckling blades 16 are fixed in position, and work well with metal wire, but have a tendency to cut, mar or scrap off any material coated on such metal wire.

The chain link weaving machine itself may be of the automatic two-wire type wherein wire from two large coils of wire (not shown) are continuously fed into a coiling mechanism 18 so that two wires at a time are intercoiled and then woven by a weaving mechanism 20 to form the continuous links of chain link fabric or material 14. After weaving, the two wires just woven are cut by a cutting mechanism, not shown, so that sharpened ends 22 and 24 of the wires in the chain link material 14 are provide at both sides of the material 14 (only one side of which is shown). The woven chain link material is then indexed up over rollers 26, 28 in the machine 10, in a known manner. Since the chain link material 14 is normally made from a galvanized steel, aluminum, or the like, of sufficient gauge to provide a strong material which is generally resistant to weather, the knuckling blades 16 in the turret assemblies 12 normally bend over the ends 22 and 24. However, as discussed above, if the chain link material has a coating, such as PVC thereon, the known knuckling blades 16 tend to cut, mar or scrap off the coating.

Figure 2:
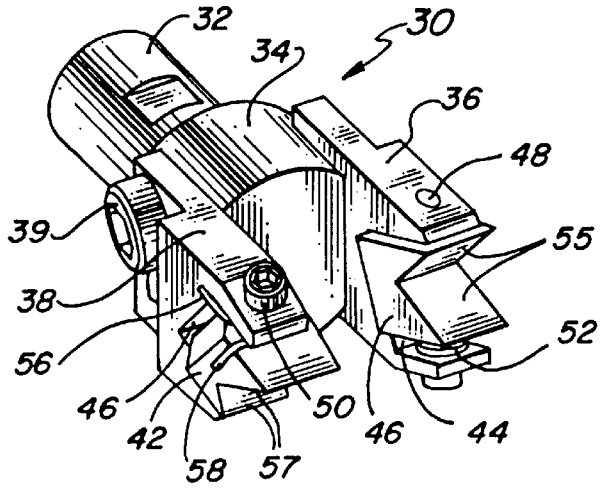
FIG. 2 is an enlarged perspective view of an improved knuckler of the present invention.
Figure 3:
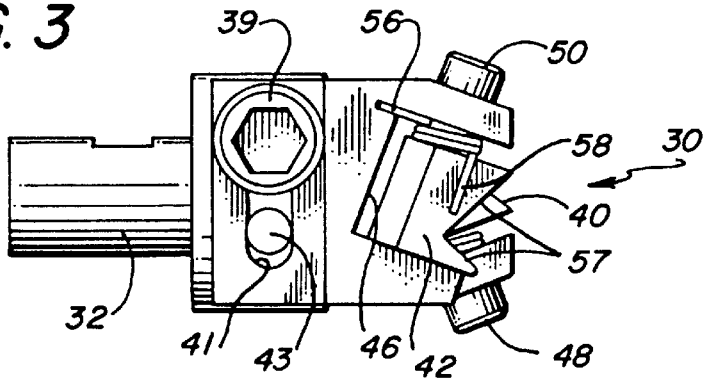
FIG. 3 is a side elevational view of FIG. 2.

Therefore, as shown in FIGS. 2 and 3, the known knuckling blades 16 are replaced by an improved knuckling apparatus 30 of the present invention. The knuckling assemblies 30 are preferably located intermediate to the rollers 26 and 28 on the machine 10, and are adapted to replace the knuckling blades 16 in turret 12. The knuckling assemblies 30 of the present invention are comprised of a holding portion 32, preferably cylindrical, with offset portions therein, for mounting in the turret 12. The holding portion 32 is in turn secured to a head assembly 34. The head assembly 34 adjustably supports a pair of arm 36, 38 having bend or wire grabbing elements 40, 42 rotatably held within angled openings 44, 46 formed in the outer ends of arms 36, 38. Each of the bend or wire grabbing elements 40, 42 is rotatably held at an angle, between about 10 and 22 degrees, in its respective opening 44, 46 in the outer end of arms 36, 38 by a shaft 48, 50, secured in apertures formed in the arms. A spring 52, 54, is mounted around each of the shafts 48, 50, and includes ends, such as 56, 58, cooperating with the elements 40, 42 and the openings 44, 46. The springs 52, 54 bias each element 40, 42 into a start or rest position, as shown in FIGS. 2 and 3. Because of the construction and biasing action of springs 52, 54, each element 40, 42 may pivot in either direction, outwardly from the rest position shown in FIGS. 2 and 3, as explained more fully below.

The inner ends of the arms 36, 38, secured to the head assembly 34, include bolt or other adjusting elements 39, held therein, to allow the arms 36, 38 to be loosened and adjusted vertically (upwardly or downwardly) along a slot 41 via a guide or pin 43.

It should be noted that the arms 36, 38 are preferably identical so that when mounted on head assembly 34 they are turned 180° with respect to each other, so as to hold the bend elements 40, 42 at different angles therein.

Figure 4:
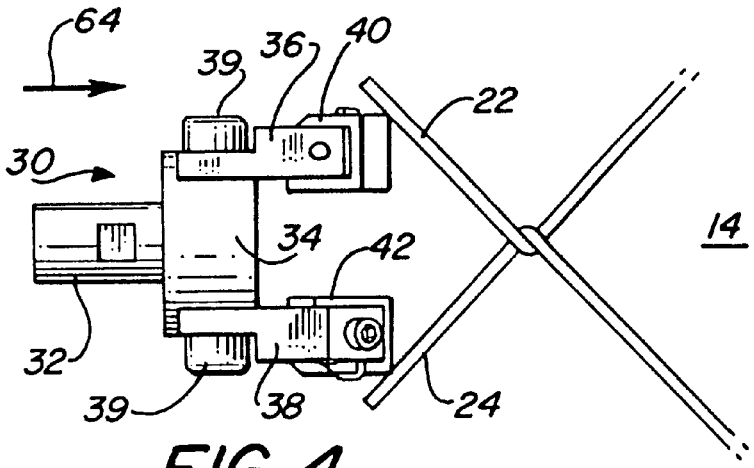
FIGS. 4 through 6 are schematic representations of the improved knuckler of the present invention, moving into contact with and bending the cut ends of the coated wires on one side of the chain link material.
Figure 5:
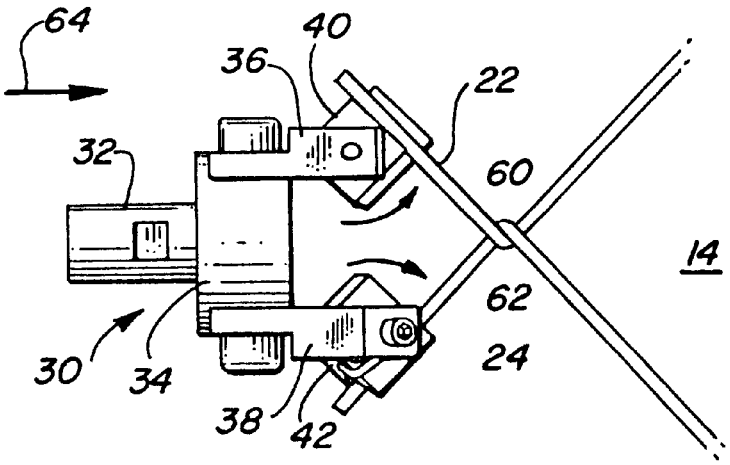
Figure 6:
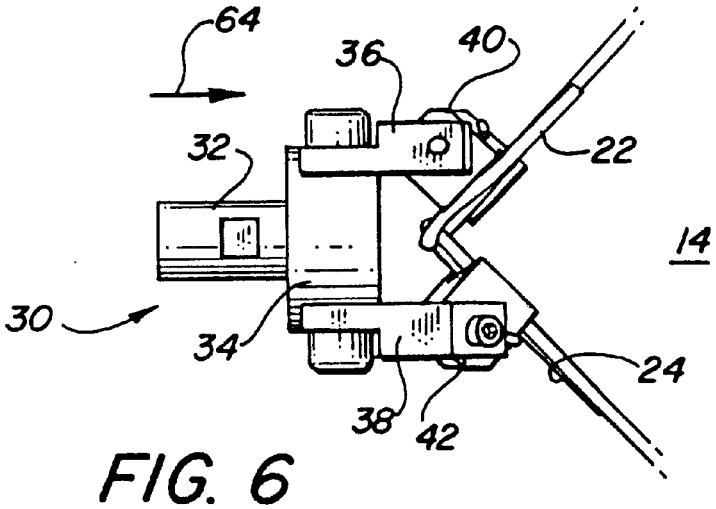

Turning now to FIGS. 4 through 6, there shown are schematic representations of the operation of the apparatus 30, for bending over the cut ends 22, 24. It is to be understood that the knuckler assemblies 30 are normally mounted in pairs in opposed turret assemblies 12. However, only one knuckler assembly 30 is shown and described, for reasons of clarity. In operation, the coated chain link material 14 is formed by the coiling, weaving and cutting mechanisms of machine 10. The formation occurs in increments as each pair of coated wires are woven into the material, while the completed, coated chain link material 14 remains stationary. Once each pair of coated wires is woven into the end of the chain link material 14 and cut off to form ends 22, 24, the completed chain link fabric 14 is moved incrementally over the guide rollers 26 and 28 by a take up unit (not shown), of a type well known to those skilled in the art. This movement positions the chain link material to receive the next pair of wires for weaving. The bending or knuckling over of the cut ends 22, 24 of the coated wires in the chain link material is preformed at the same time the chain link material 14 is being woven. The take up unit is driven intermittently to provide for the desired incremental movement of the chain link material 14, and, therefore, the end knuckling assemblies 30 are operated in accordance with the intermittent movement of the take up unit.

For example, the end knuckling assembly 30 may be actuated by operating means connected to the turret 12, such as a pneumatic actuator, to move the turret assemblies 12 with the knuckling assembly 30 therein, in the direction of arrow 64, to a forward or operating position as shown in FIG. 4. The cut ends 22, 24 of the respective coated wires will then be in position in front of the bend or wire grabbing elements 40, 42. The knuckling assembly 30 is then actuated so as to move the knuckling elements 40, 42 into contact with the cut ends 22, 24, rotated outwardly, as shown by arrows 60, 62 in FIG. 5. In this position, angled inner faces 55, 57 of the rotated blades 40, 42 contact the ends 22, 24 along an extended length which is equal to the width of the blades 40, 42. The angled faces are preferably of different lengths and formed at different angles. For example, as shown in FIG. 3, a shorter or lower face or leg portion thereof could be formed at a shallow angle of about 20 degrees, while a longer or upper face or leg portion could be formed at an angle of approximately 62 degrees to the lower leg portion.

Thus, when bending the cut ends by moving the assembly 30 further in the direction of arrow 64, as shown in FIGS. 5 and 6, the maximum area of the angled faces 55, 57 of blades 40, 42 contacts the cut ends 22, 24 and enables these cut ends to be bent or knuckled over to the position shown in FIG. 6. The knuckled end portions 22, 24 are thus bent into the desired position without cutting, marring or scraping the coating on the ends of the wire being bent. In addition to the enlarged contact area with angled faces 55, 57 preferably at the area where the two different angled faces meet, the bending is aided by the rotation of the elements 40,42 with the end portions 22, 24, as the knuckler 30 is moved further in the direction of arrow 64, minimizing the slipping action against the cut ends, which normally tends to peel or scrape the coatings. When the cut ends 22, 24 are fully bent, the elements 40, 42 will be rotated to the positions shown in FIG. 6. The knuckler 30 may then be withdrawn, and the springs 52, 54 will rotate the elements 40, 42 back to their start positions, where they will be ready to bend the next indexed pair of cut ends 22, 24.

It is to be understood that other shaped elements, equivalent to elements 40, 42, may be used to bend the ends 22, 24, as long as such elements grasp the cut ends over an extended contact area, so as to prevent cutting, marring or scraping of the coating thereon. For example, the angled faces may be formed at various angles, or in other configuration, such as curved or shaped, so as to securely grasp the cut ends, and efficiently bend them, no matter what the diameter of the material being bent.

Thus, there has been described an improved apparatus for bending or knuckling over cut ends of a coated chain link material in place of the known knuckling devices, heretofore available. These improved knuckling apparatus contact cut ends over an extended length, and then bend these cut ends so that the coating is not cut, marred or scraped, to thereby form knuckled, coated chain link fencing material that will last longer, and which will have an improved appearance.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. An apparatus for bending cut end portions of coated chain link material, comprising, in combination:

means for securing the apparatus in a turret;

means for bending the cut end portions of coated wire material woven into chain link fabric by a wire weaver;

the means for bending the cut end portions including a pair of separately rotatable elements for contacting and bending the cut ends into the chain link fabric; and means for biasing the pair of rotatable elements to a start position.

2. The apparatus of claim 1 wherein the pair of separately rotatable elements have angled face portions for contacting the cut end portions over an extended length.

3. The apparatus of claim 2 wherein the pair of separately rotatable elements are held in a pair of arms extending from a head assembly.

4. The apparatus of claim 3 wherein the means for biasing the pair of separately rotatable elements comprises springs held in openings formed at one end of the pair of arms, and the springs cooperate with the pair of rotatable elements to bias the pair of rotatable elements into the start position.

5. The apparatus of claim 4 wherein the pair of separately rotatable elements include shafts held in the openings.

6. The apparatus of claim 1 wherein the means for biasing is a pair of springs.

7. The apparatus of claim 6 wherein the means for securing the apparatus in a turret includes a turret holding portion and a head assembly secured to the turret holding portion; a pair of arms is secured to the head assembly by a first end; the pair of arms having angled openings formed therein at a second end; and the means for biasing the separately rotatable elements is a pair of springs.

8. The apparatus of claim 7 wherein the pair of separately rotatable elements include a shaft and a wire grabbing surface, and are held in the angled openings.

9. The apparatus of claim 8 wherein the wire grabbing surface is comprised of a pair of angled faces, and each of the pair of arms holding the separately rotatable elements are identical and mounted to the head assembly so that the pair of separately rotatable elements extend outwardly at different angles.

10. The apparatus of claim 9 wherein the pair of springs are mounted on the shafts of the separately rotatable elements, and include ends which cooperate with the openings and the separately rotatable elements to bias the separately rotatable elements into the start position.

11. A knuckler apparatus for bending cut end portions on linked, coated wires in a chain link material, comprising:

a turret holding portion;

a head portion secured to the turret holding portion;

a pair of separately rotatable means for bending the cut end portions held in the head portion; and means for biasing the pair of separately rotatable means for bending the cut end portions.

12. The knuckler apparatus of claim 11 wherein the head portion includes a pair of identical arms adjustably secured thereto for supporting the pair of separately rotatable means for bending the cut end portions.

13. The knuckler apparatus of claim 12 wherein the pair of identical arms include angled openings at one end thereof, and the pair of separately rotatable means for bending the cut end portions are rotatably mounted in the angled openings by shafts connected to the pair of separately rotatable means for bending the cut end portions.

14. The knuckler apparatus of claim 13 wherein the pair of separately rotatable means for bending the cut end portions comprise rotatable bend elements having angled wire grabbing surfaces formed thereon.

15. The knuckler apparatus of claim 14 wherein the means for biasing are a pair of springs mounted on the shafts, and the pair of springs cooperate with the angled openings and the rotatable bend elements to bias the rotatable bend elements into start positions.

16. A knuckler apparatus for bending cut end portions of a coated chain link material, comprising, in combination:

a cylindrical turret holding portion;

a head portion secured to the cylindrical turret holding portion;

a pair of arms having a first end and a second end; each of the pair of arms being secured to the head portion by the second end; each of the pair of arms including an angled opening formed therein on the first end;

a bend element rotatably held in each angled opening; each bend element, including an angled face portion, adapted to contact an extended length of the cut end portions; and means for biasing the bend element held in each angled opening and cooperating with each bend element and each angled opening.

17. The knuckler apparatus of claim 16 wherein the pair of arms are identical, and are adjustably held in the head portion.

18. The knuckler apparatus of claim 17 wherein each bend element includes a shaft, and each shaft is held in an angled opening.

19. The knuckler apparatus of claim 18 wherein the means for biasing the bend element is a spring mounted on the shaft and cooperating with the angled opening and the bend element.

20. The knuckler apparatus of claim 16 wherein the pair of identical arms are adjustably held in the head portion by an adjusting bolt and a slot and pin arrangement.

* * * * *